US008381749B1

(12) United States Patent
Ashmore, Jr.

(10) Patent No.: US 8,381,749 B1
(45) Date of Patent: Feb. 26, 2013

(54) ADJUSTABLE HUNTING BLIND

(76) Inventor: William D. Ashmore, Jr., Seffner, FL (US)

( * ) Notice: Subject to any disclaimer, the term of this patent is extended or adjusted under 35 U.S.C. 154(b) by 67 days.

(21) Appl. No.: 13/072,965

(22) Filed: Mar. 28, 2011

(51) Int. Cl.
*E04H 15/04* (2006.01)

(52) U.S. Cl. ..... 135/96; 135/90; 135/901

(58) Field of Classification Search ..... 135/16, 135/21, 87, 901, 96, 98; 43/1–3
See application file for complete search history.

(56) References Cited

U.S. PATENT DOCUMENTS

| | | | | | |
|---|---|---|---|---|---|
| 1,581,180 | A | * | 4/1926 | Csajaghy et al. | 135/150 |
| 2,484,401 | A | * | 10/1949 | Cote | 135/86 |
| 3,008,477 | A | | 11/1961 | Bester | |
| 3,383,814 | A | * | 5/1968 | Rowe | 52/83 |
| 3,570,507 | A | * | 3/1971 | Kashuba | 135/123 |
| 3,622,201 | A | | 11/1971 | Radig | |
| 3,902,264 | A | | 9/1975 | Radig | |
| 4,086,931 | A | * | 5/1978 | Hall | 135/98 |
| 4,449,542 | A | * | 5/1984 | McSwain et al. | 135/98 |
| 4,825,578 | A | * | 5/1989 | Robinson | 43/1 |
| 4,951,696 | A | | 8/1990 | Jones, Sr. | |
| 5,172,525 | A | | 12/1992 | Cook | |
| 5,214,872 | A | | 6/1993 | Buyalos, Jr. | |
| 5,255,954 | A | * | 10/1993 | Rogers | 297/184.16 |
| 5,430,980 | A | * | 7/1995 | Ferrier | 52/63 |
| 5,630,439 | A | | 5/1997 | Hutto | |
| 5,641,197 | A | * | 6/1997 | Springmann | 297/188.11 |
| 5,749,386 | A | * | 5/1998 | Samuel, Jr. | 135/16 |
| 5,813,160 | A | | 9/1998 | Thoelke | |
| 6,431,192 | B2 | | 8/2002 | O'Hare | |
| 6,666,223 | B2 | * | 12/2003 | Price et al. | 135/131 |
| 7,007,703 | B2 | * | 3/2006 | Brooks, III | 135/16 |
| 7,201,442 | B1 | * | 4/2007 | Decosta, Jr. | 297/184.16 |
| 7,219,680 | B1 | * | 5/2007 | Gresock | 135/90 |
| 7,226,126 | B1 | * | 6/2007 | Spanovich | 297/184.16 |
| 7,527,330 | B2 | * | 5/2009 | Montpas | 297/184.15 |
| 2002/0036007 | A1 | | 3/2002 | Sellers | |
| 2003/0098055 | A1 | * | 5/2003 | Johnson | 135/901 |
| 2010/0252083 | A1 | * | 10/2010 | Ogle | 135/90 |

* cited by examiner

*Primary Examiner* — Noah Chandler Hawk

(57) ABSTRACT

An adjustable hunting blind for providing convenient organized tool storage and an optimized shelter configuration for various situations commonly encountered by hunters includes a pole. An extension arm is coupled to and extendable from the pole. A spike is coupled to a bottom end of the pole so that the spike extends from a bottom end of the pole. The pole extends upwardly from a ground surface when the spike is inserted into the ground surface. A canvas coupled to the extension arm so that the canvas hangs from the extension arm. An expansion ring is coupled to the canvas proximate a top of the canvas for holding the canvas in an expanded position when the canvas hangs from said extension arm.

18 Claims, 5 Drawing Sheets

ADJUSTABLE HUNTING BLIND

BACKGROUND OF THE DISCLOSURE

Field of the Disclosure

The disclosure relates to hunting blind devices and more particularly pertains to a new hunting blind device for providing convenient organized tool storage and an optimized shelter configuration for various situations commonly encountered by hunters.

SUMMARY OF THE DISCLOSURE

An embodiment of the disclosure meets the needs presented above by generally comprising a pole. An extension arm is coupled to and extendable from the pole. A spike is coupled to a bottom end of the pole so that the spike extends from a bottom end of the pole. The pole extends upwardly from a ground surface when the spike is inserted into the ground surface. A canvas coupled to the extension arm so that the canvas hangs from the extension arm. An expansion ring is coupled to the canvas proximate a top of the canvas for holding the canvas in an expanded position when the canvas hangs from said extension arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
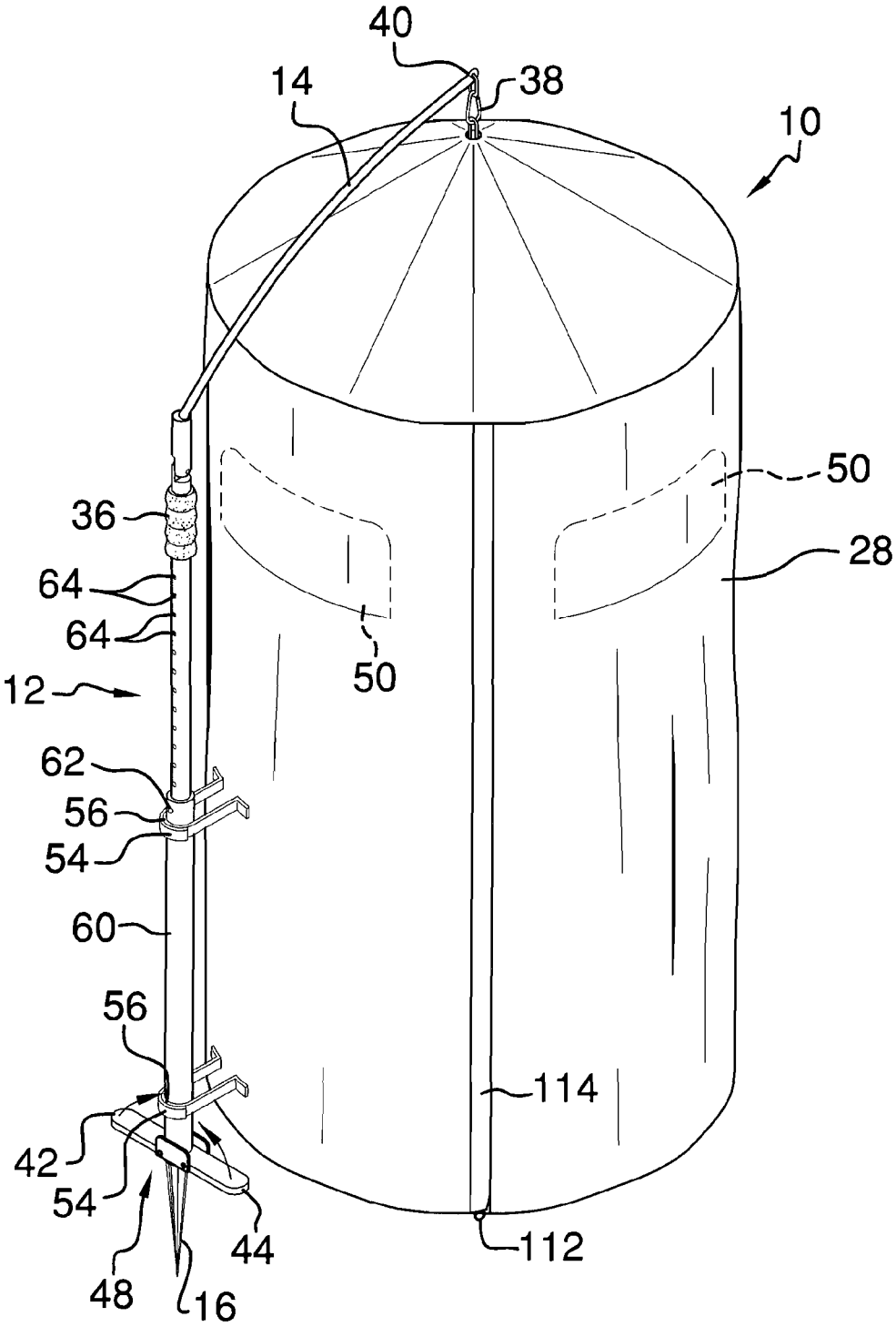
FIG. 1 is a top front side perspective view of a adjustable hunting blind according to an embodiment of the disclosure.
Figure 2:
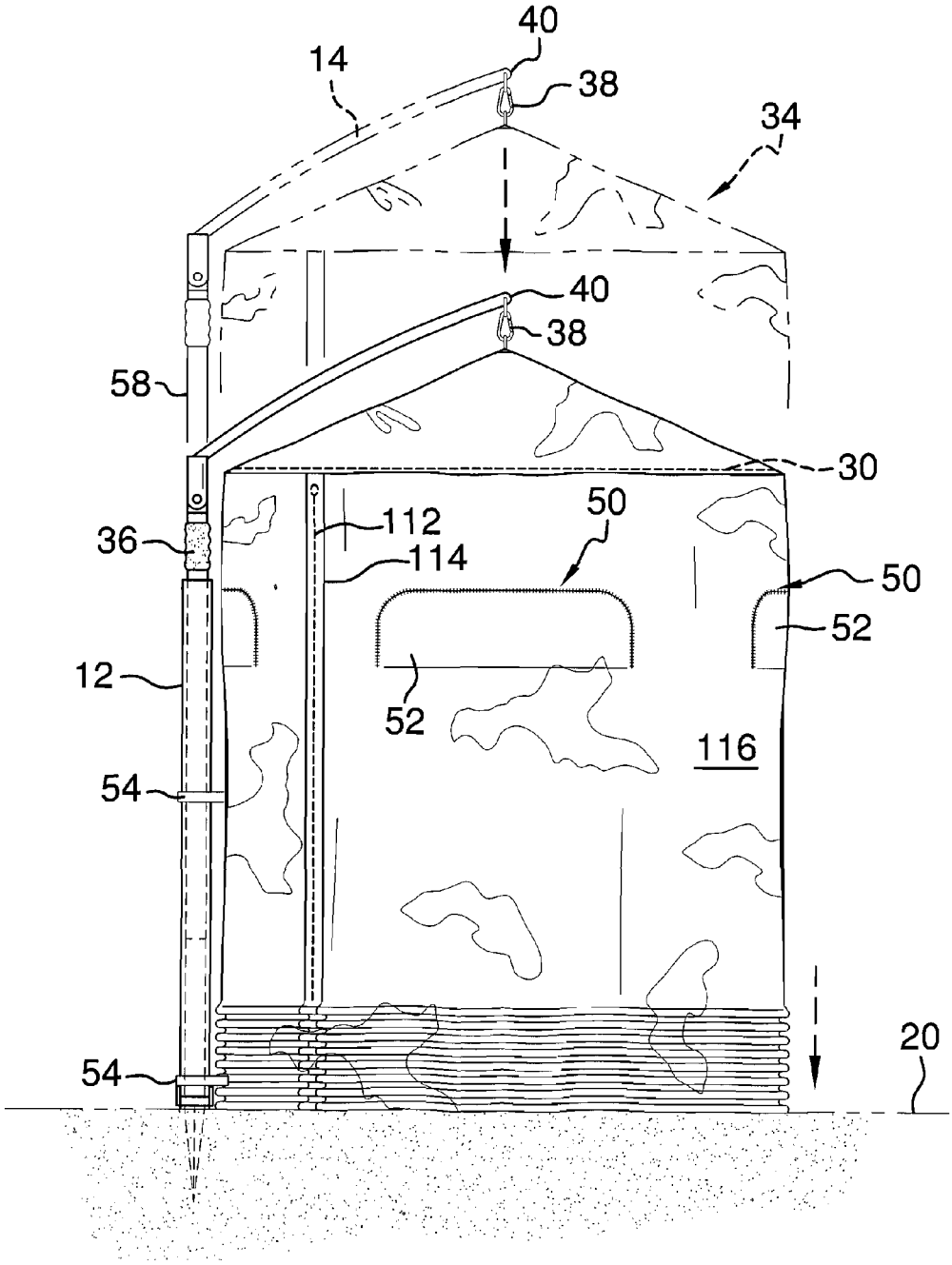
FIG. 2 is a front view of an embodiment of the disclosure.

With reference now to the drawings, and in particular to FIGS. 1 through 5 thereof, a new hunting blind device embodying the principles and concepts of an embodiment of the disclosure and generally designated by the reference numeral 10 will be described.

Figure 3:
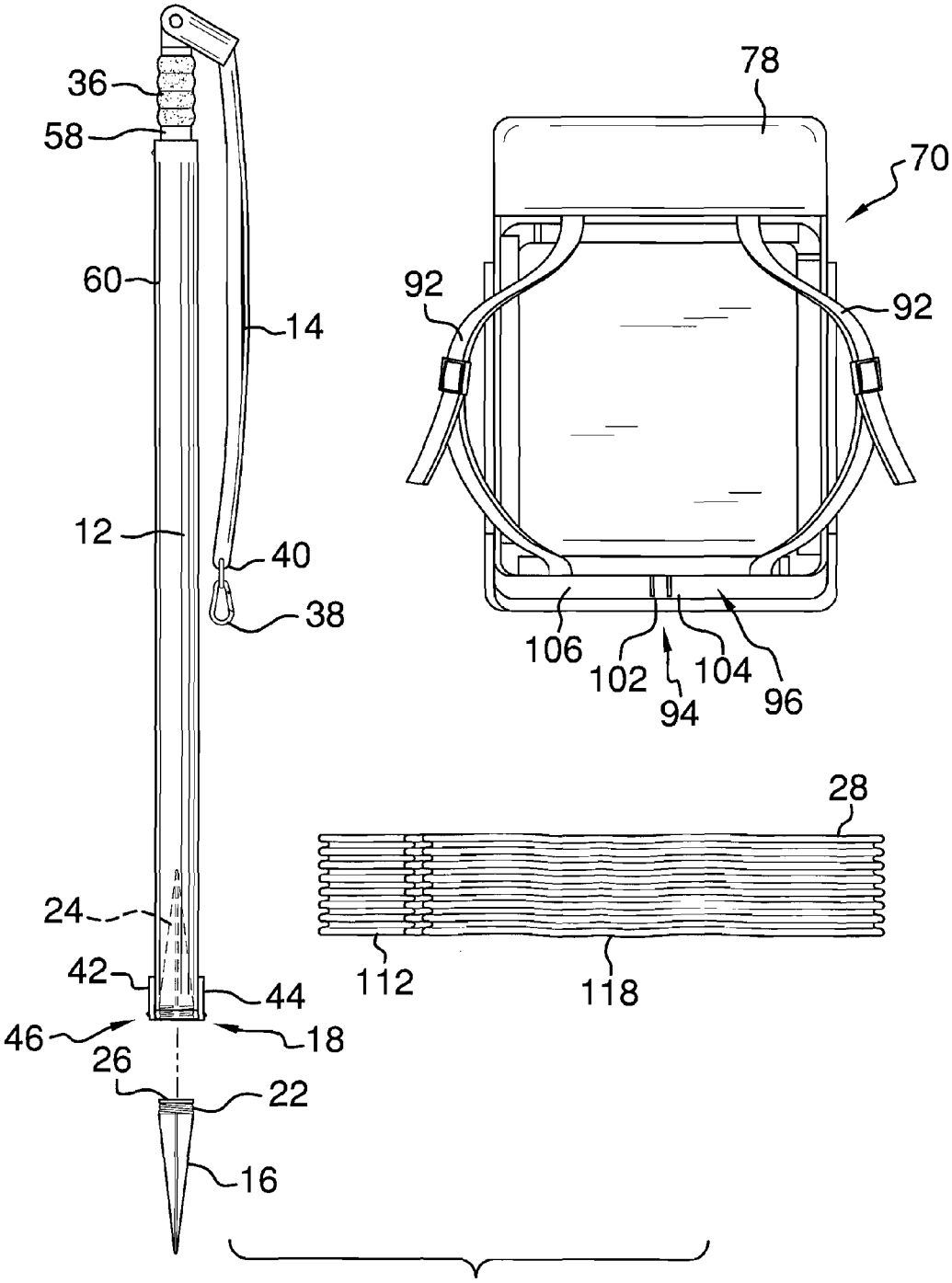
FIG. 3 is a partially exploded detailed view of an embodiment of the disclosure.
Figure 4:
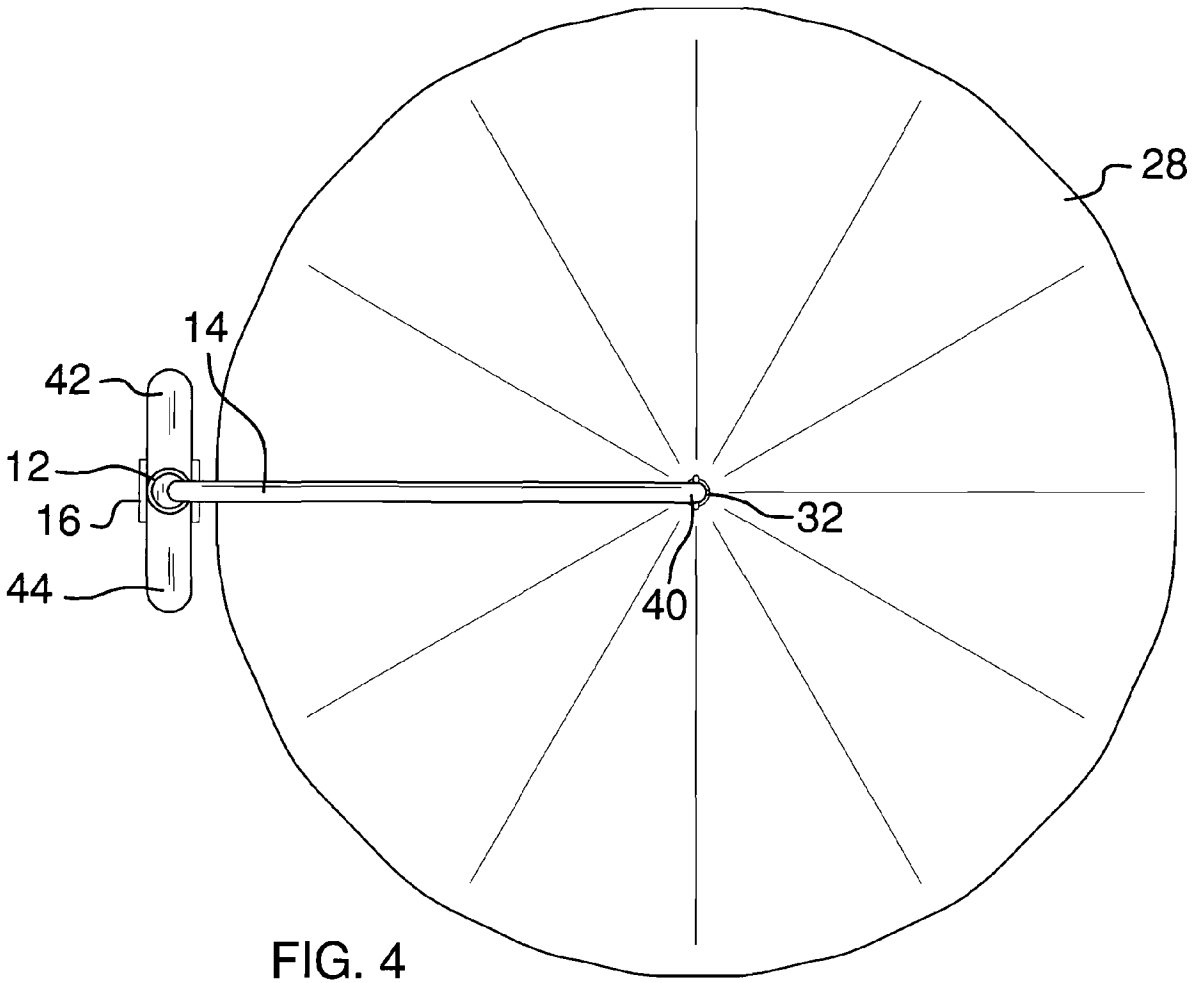
FIG. 4 is a top view of an embodiment of the disclosure.
Figure 5:
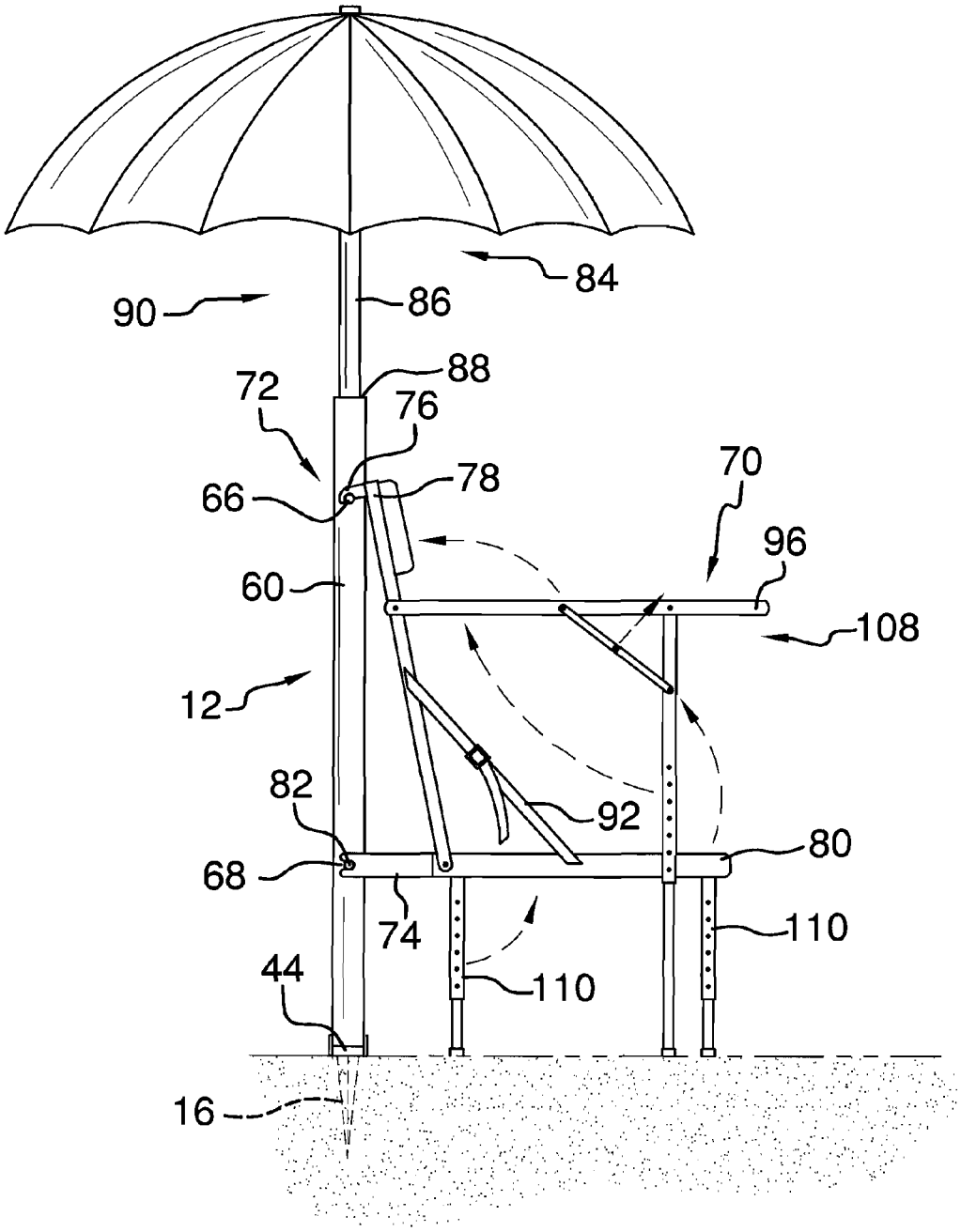
FIG. 5 is a side view of an alternate embodiment of the disclosure.

As best illustrated in FIGS. 1 through 6, the adjustable hunting blind 10 generally comprises a pole 12 and an extension arm 14 selectively couplable to and extendable from the pole 12. A spike 16 is couplable to a bottom end 18 of the pole 12 such that the spike 16 extends from the bottom end 18 of the pole 12. Thus, the pole 12 is configured for extending upwardly from a ground surface 20 when the spike 16 is inserted into the ground surface 20. The spike 16 may have threading 22 so that the spike 16 is selectively removable from the pole 12. The spike 16 may be further couplable to the pole 12 in an inverted position 24, as shown in FIG. 3, such that the spike 16 extends into the bottom end 18 of the pole 12. The inverted position 24 of the spike 16 exposes a frictional planar end surface 26 of the spike 16 extending from the bottom end 18 of the pole 12 such that the pole 12 is configured for use as a walking stick. A hand grip 36 is coupled to the pole 12 to facilitate manipulation of the pole 12 during use as a walking stick.

A canvas 28 is couplable to the extension arm 14 such that the canvas 28 hangs from the extension arm 14. An expansion ring 30 is coupled to the canvas 28 proximate a top 32 of the canvas 28 for holding the canvas 28 in an expanded position 34 when the canvas 28 hangs from the extension arm 14. A loop 38 is coupled to the top 32 of the canvas 28. A carabineer 38 or similar connector is coupled to a distal end 40 of the extension arm 14 relative to the pole 12 for facilitating attachment of the top 32 of the canvas 28 to the extension arm 14.

A pair of opposed foot levers 42,44 are coupled to the pole 12 proximate the bottom end 18 of the pole 12. The foot levers 42,44 are pivotable between a storage position 46 and a use position 48.

A plurality of openings 50 are provided in the canvas 28. A plurality of flaps 52 is also provided. The flaps 52 are securable to selectively open and close the openings 50 in the canvas 28 as desired. The flaps 52 may be secured by hook and loop fastener, zippers or other conventional means of closure. A plurality of bands 54 is provided. The bands 54 extend from the canvas 28 and are vertically aligned along a vertical length of the canvas 28. The bands 54 are positioned for securing the canvas 28 to the pole 12 when the top 32 of the canvas 28 is hung from the extension arm 14. Complimentary portions of hook and loop fastener 56 may be coupled to the bands 54 for facilitating securing the canvas 28 to the pole 12. A closure 112 extends along a length of the canvas 28 downward from the expansion ring 30 for facilitating entry into and exit from the canvas 28 when the canvas 28 hangs from the extension arm 14. An overlap 114 is coupled to the canvas 28 covering the closure 112.

An upper section 58 of the pole 12 is slidably inserted into a lower section 60 of the pole 12. A stop member 62 is couplable to the upper section 58 of the pole 12 and the lower section 60 of the pole 12 for securing the upper section 58 in a stable position relative to the lower section 60. Thus, the pole 12 is telescopic. The stop member 62 may be internally positioned in the pole 12 and biased outwardly to facilitate engagement of a selected one of a plurality of apertures 64. The apertures 64 extend in spaced relationship to each other along a length of the upper section 58 of the pole 12. The stop member 62 is engageable to a selectable one of the apertures 64 for adjusting the pole 12 to a desired length.

An upper peg 66 may be coupled to and extend from the pole 12. A lower peg 68 may similarly be coupled to and extend from the pole 12. A collapsible chair assembly 70 may be provided having an upper attachment arm 72 and a lower attachment arm 74. A hook 76 is coupled to the chair assembly 70 proximate a head support 78 of the chair assembly 70. The hook 76 is couplable to the upper peg 66 when the chair assembly 70 is attached to the pole 12. The lower attachment arm 74 is coupled to and extends from a seat portion 80 of the chair assembly 70. The lower attachment arm 74 has a groove 82. The lower peg 68 is insertable into the groove 82 when the hook 76 is coupled to the upper peg 66 such that the lower attachment arm 74 engages the lower peg 68 to stabilize the chair assembly 70. A plurality of straps 92 is coupled to the chair assembly 70. The straps 92 are configured for passing over and around shoulders of a user to facilitate carrying the chair assembly 70 in a collapsed position 94 during periods of non-use. A shooting rest 96 may extend from a top portion 98 of the chair assembly 70 when the chair assembly 70 is in an expanded position 100. The shooting rest 96 may have a break 102 between opposite sides 104,106 that are pivotable to provide open access to the seat portion 80 of the chair assembly 70. Thus, the shooting rest 96 may extend fully across a front 108 of the chair assembly 70 while still providing easy access to the seat portion 80. A plurality of collapsible and extendable support legs 110 is also provided for supporting the chair assembly 70 in the expanded position 100.

An umbrella attachment 84 may be provided having a post 86 insertable into a top 88 of the lower section 60 of the pole 12. Thus, the lower section 60 of the pole 12 may alternatively be used to support the umbrella attachment 84 in an upright position 90 substantially over the chair assembly 70.

The canvas 28 may also be provided with a plurality of exterior loops to facilitate the application and retention of brush to an exterior surface 116 of the canvas 28 to facilitate camouflaging the blind 10. Tent pegs may also be provided for securing a bottom perimeter 118 of the canvas 28 to further secure the canvas 28 during use. The exterior loops may be arranged in spaced rings along the vertical length of the canvas 28 to facilitate securing the canvas 28 to the ground surface 20 at a desired vertical length to permit standing or sitting in the blind 10 as desired while minimizing the profile of the blind 10. Drawstrings may also be provided at the top 32 of the canvas 28 and a bottom of the canvas 28 so that the canvas 28 may be used as an emergency shelter or hammock in a horizontal position between two vertical supports if desired or required.

In use, the pole 12 is assembled and erected at a desired length using the spike 16 and the foot levers 42,44. The extension arm 14 is positioned and the canvas 28 is hung from the extension arm 14. The expansion ring 30 holds the canvas 28 in a tubular shape providing a space surrounded by the canvas 28. The canvas 28 is further secured to the pole 12 using bands 54. The user may enter the canvas 28 through the opened closure 112 and close the closure 112 to obscure the user from view. The flaps 52 may be opened as desired to provide a view out of the canvas 28. If desired, the pole 12 may also be used as a walking stick with the spike 16 in the inverted position 24. Alternatively to the canvas 28, the chair assembly 70 may be attached to the pole 12 to provide a comfortable seated position while hunting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hunting blind assembly comprising:

a pole;

an extension arm coupled to and extendable from said pole;

a spike couplable to a bottom end of said pole such that said spike extends from a bottom end of said pole whereby said pole is configured for extending upwardly from a ground surface when said spike is inserted into the ground surface;

a canvas couplable to said extension arm such that said canvas hangs from said extension arm;

an expansion ring coupled to said canvas proximate a top of said canvas for holding said canvas in an expanded position when said canvas hangs from said extension arm;

an upper peg coupled to and extending from said pole;

a lower peg coupled to and extending from said pole;

a collapsible chair assembly having an upper attachment arm and a lower attachment arm;

a hook coupled to said chair assembly proximate a head support of said chair assembly, said hook being couplable to said upper peg;

said lower attachment arm being coupled to and extending from a seat portion of said chair assembly, said lower attachment arm having a groove, said lower peg being insertable into said groove when said hook is coupled to said upper peg such that said support arm engages said lower peg to stabilize said chair assembly; and a shooting rest extending from a top portion of said chair assembly when said chair assembly is in an expanded position, said shooting rest extending across a front of said seat portion.

2. The assembly of claim 1, further including a hand grip coupled to said pole.

3. The assembly of claim 1, further comprising:

a loop coupled to said top of said canvas; and a carabineer coupled to a distal end of said extension arm relative to said pole for facilitating attachment of said top of said canvas to said extension arm.

4. The assembly of claim 1, further including said spike being selectively removable from said pole, said spike being further couplable to said pole in an inverted position such that said spike extends into said bottom end of said pole exposing a frictional planar end surface of said spike extending from said bottom end of said pole such that said pole is configured for use as a walking stick.

5. The assembly of claim 1, further including a foot lever coupled to said pole proximate a bottom end of said pole, said foot lever being pivotable between a storage position and a use position.

6. The assembly of claim 1, further including a pair of opposed foot levers coupled to said pole proximate a bottom end of said pole, said foot levers being pivotable between a storage position and a use position.

7. The assembly of claim 1, further comprising:

a plurality of openings in said canvas; and a plurality of flaps securable to selectively open and close said openings in said canvas.

8. The assembly of claim 1, further including a plurality of bands extending from said canvas, said bands being positioned for securing said canvas to said pole when a top of said canvas is hung from said extension arm.

9. The assembly of claim 8, further including complimentary portions of hook and loop fastener coupled to said bands for facilitating securing said canvas to said pole.

10. The assembly of claim 1, further comprising:

an upper section of said pole being slidably inserted into a lower section of said pole; and a stop member couplable to said upper section of said pole and said lower section of said pole for securing said upper section in a stable position relative to said lower section of said pole whereby said pole is telescopic.

11. The assembly of claim 10, further including a plurality of apertures extending in spaced relationship along a length of said upper section of said pole, said stop member being engageable to a selectable one of said apertures for adjusting said pole to a desired length.

12. The assembly of claim 1, further including an umbrella attachment having a post insertable into a top of a lower section of said pole whereby said lower section of said pole supports said umbrella attachment in an upright position.

13. The assembly of claim 1, further including a plurality of straps coupled to said chair assembly, said straps being configured for passing over and around shoulders of a user to facilitate carrying said chair assembly in a collapsed position during periods of non-use.

14. The assembly of claim 1, wherein said chair assembly includes collapsible and extendable support legs for supporting said chair assembly in an expanded position.

15. The assembly of claim 1, further including a closure extending along a length of said canvas downward from said expansion ring for facilitating entry into and exit from said canvas when said canvas hangs from said extension arm.

16. The assembly of claim 15, further including an overlap coupled to said canvas covering said closure.

17. The assembly of claim 1, further including said shooting rest having a break between opposite sides of said shooting rest, said opposite sides of said shooting rest being pivotable wherein open access to said seat portion.

18. A hunting blind assembly comprising:

a pole;

an extension arm coupled to and extendable from said pole;

a spike couplable to a bottom end of said pole such that said spike extends from a bottom end of said pole whereby said pole is configured for extending upwardly from a ground surface when said spike is inserted into the ground surface, said spike being selectively removable from said pole, said spike being further couplable to said pole in an inverted position such that said spike extends into said bottom end of said pole exposing a frictional planar end surface of said spike extending from said bottom end of said pole such that said pole is configured for use as a walking stick;

a canvas couplable to said extension arm such that said canvas hangs from said extension arm;

an expansion ring coupled to said canvas proximate a top of said canvas for holding said canvas in an expanded position when said canvas hangs from said extension arm;

a hand grip coupled to said pole;

a loop coupled to said top of said canvas; and a carabineer coupled to a distal end of said extension arm relative to said pole for facilitating attachment of said top of said canvas to said extension arm;

a pair of opposed foot levers coupled to said pole proximate said bottom end of said pole, said foot levers being pivotable between a storage position and a use position;

a plurality of openings in said canvas;

a plurality of flaps securable to selectively open and close said openings in said canvas;

a plurality of bands extending from said canvas, said bands being positioned for securing said canvas to said pole when said top of said canvas is hung from said extension arm, complimentary portions of hook and loop fastener coupled to said bands for facilitating securing said canvas to said pole;

an upper section of said pole being slidably inserted into a lower section of said pole;

a stop member couplable to said upper section of said pole and said lower section of said pole for securing said upper section in a stable position relative to said lower section of said pole whereby said pole is telescopic;

a plurality of apertures extending in spaced relationship along a length of said upper section of said pole, said stop member being engageable to a selectable one of said apertures for adjusting said pole to a desired length;

an upper peg coupled to and extending from said pole;

a lower peg coupled to and extending from said pole;

a collapsible chair assembly having an upper attachment arm and a lower attachment arm, said lower attachment arm being coupled to and extending from a seat portion of said chair assembly, said lower attachment arm having a groove, said lower peg being insertable into said groove when said hook is coupled to said upper peg such that said lower attachment arm engages said lower peg to stabilize said chair assembly;

a hook coupled to said chair assembly proximate a head support of said chair assembly, said hook being couplable to said upper peg;

an umbrella attachment having a post insertable into a top of said lower section of said pole whereby said lower section of said pole supports said umbrella attachment in an upright position;

a plurality of straps coupled to said chair assembly, said straps being configured for passing over and around shoulders of a user to facilitate carrying said chair assembly in a collapsed position during periods of non-use;

a shooting rest extending from a top portion of said chair assembly when said chair assembly is in an expanded position;

a plurality of collapsible and extendable support legs for supporting said chair assembly in an expanded position;

a closure extending along a length of said canvas downward from said expansion ring for facilitating entry into and exit from said canvas when said canvas hangs from said extension arm; and an overlap coupled to said canvas covering said closure.

* * * * *